United States Patent [19]

Beard

[11] 4,305,700

[45] Dec. 15, 1981

[54] AIR LIFT PUMP FOR WELLS, AND MEANS OF CONTROLLING SAME BY THE FLUID LEVEL IN THE WELL CASING

[76] Inventor: Frank Beard, 14906 Cindywood, Houston, Tex. 77024

[21] Appl. No.: 23,653

[22] Filed: Mar. 26, 1979

[51] Int. Cl.[3] ..... F04F 1/08; F04F 1/12

[52] U.S. Cl. ..... 417/121

[58] Field of Search ..... 417/121, 122, 125, 102

[56] References Cited

U.S. PATENT DOCUMENTS

| | | | |
|---|---|---|---|
| 992,711 | 5/1911 | Freeman | 417/121 |
| 995,248 | 6/1911 | Gildea | 417/121 |
| 1,547,830 | 7/1925 | Shortt et al. | 417/125 |
| 1,628,943 | 5/1927 | Wolcott | 417/121 |
| 1,666,463 | 4/1928 | McGogy | 417/121 |
| 1,708,471 | 4/1929 | Fainsworth | 417/125 |
| 2,864,317 | 12/1958 | Robinson | 417/121 |
| 3,342,135 | 9/1967 | Schnabel, Jr. | 417/38 |
| 3,676,019 | 7/1972 | Self . | |

FOREIGN PATENT DOCUMENTS

| | | | |
|---|---|---|---|
| 2002190 | 8/1970 | Fed. Rep. of Germany | 417/102 |
| 257241 | 8/1927 | United Kingdom | 417/121 |

*Primary Examiner*—William L. Freeh
*Attorney, Agent, or Firm*—Ranseler O. Wyatt

[57] ABSTRACT

A well pump for use in oil wells, and the like, consisting of a series of cylinders connected by a production tubing and an air circulation system having two conduits extending into the casing-tubing annulus, each cylinder having an inlet connection through the top thereof and into one of said lines, alternately, so that every other cylinder is in the same line, and a four way valve in a control box at the well head, operated by an electric motor for alternating the flow of air through the respective conduits into the cylinders, the production tubing forming a dip tube in each cylinder, and check valves at the lower ends of each cylinder to prevent backflow, the bottom cylinder being the control cylinder having a fluid level controlled switch which activates the pump, sending a charge of air into the respective cylinders, lifting the production fluid therein progressively to the earth's surface. Another conduit extends from the ground surface, through the annulus between cylinders and casing, to the desired fluid level in the casing through which a suction action may be exerted to add impetus to the flow of production fluid into the casing to be received by the bottom cylinder. This conduit may also be used to maintain a light air pressure in the bottom of the casing, which will, when blocked by the fluid level in the casing, be the resistance signal to the air pump switch, initiating the pumping cycle.

This conduit may also be used to introduce flow stimulants into the formation.

1 Claim, 2 Drawing Figures

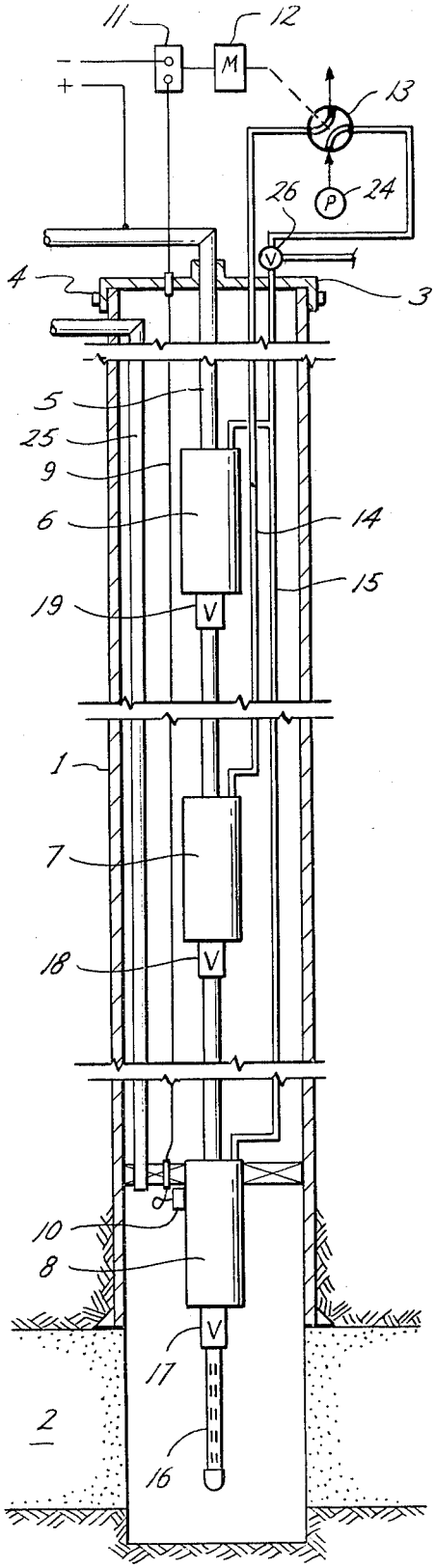
Fig. 1
Fig. 2
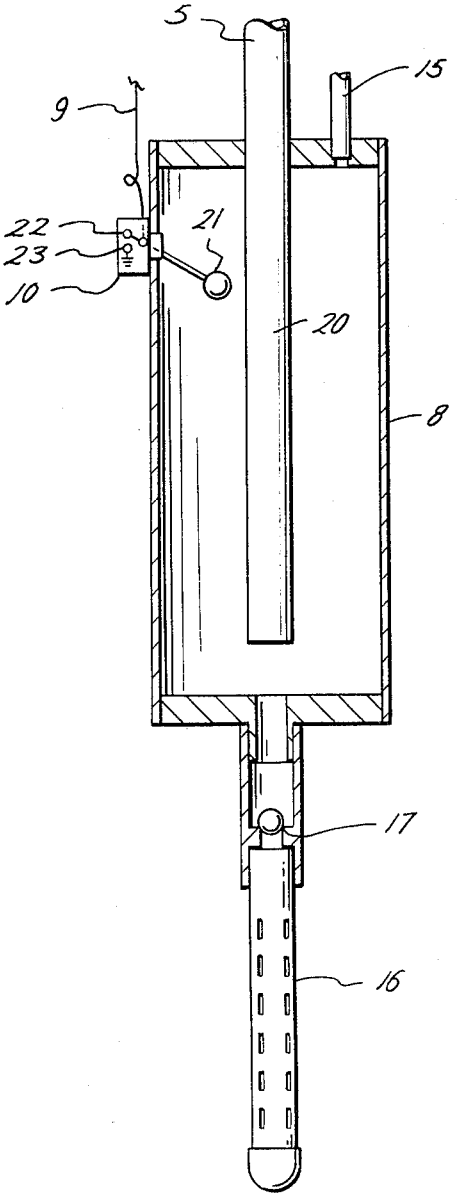

AIR LIFT PUMP FOR WELLS, AND MEANS OF CONTROLLING SAME BY THE FLUID LEVEL IN THE WELL CASING

BACKGROUND OF THE INVENTION

Air lift pumps, employing a series of cylinders that are alternately filled and exhausted, are shown in my U.S. Pat. No. 3,730,983, but, although timers greatly assist in the effeciency of the pumping operation, in stripping fields where the easily produced fluid has been taken by conventional means, even with the use of timers, often more air than oil is pumped. It is an object of the invention to increase the effeciency of this type of production, so that the pump is activated only when the control cylinder is filled to the preselected degree with production fluid.

SUMMARY OF THE INVENTION

A pump for wells, and the method of pumping, actuated by the fluid level is the casing, having a series of air lift cylinders, and terminating in a control cylinder in which a floating control actuates the air pump and the valve which alternately pressurizes and exhausts the cylinders in the production string.

BRIEF DESCRIPTION OF THE DRAWINGS

FIG. 1 is an elevational cross sectional view of the lift system in a well casing and FIG. 2 is an enlarged view, in cross section, of the control cylinder.

DESCRIPTION OF THE PREFERRED EMBODIMENTS

In the drawings, the numeral 1 designates a well casing extending from the ground surface to a production formation 2. The casing is closed with the cap 3 which may be maintained in place by bolts, 4, 4. Through the cap and extended into the well is the production tubing 5, the lift cylinders 6, 7 and the control cylinder 8. Also extended through the cap 3 is the wiring 9 leading to the switch 10 on the control cylinder 8.

At the well head will be the electrical controls 11 actuated by the switch 10, which starts the motor 12 for the timed operation of the four way valve 13 and the pump 24 which provides air pressure to the conduits 14, 15, which are also extended through the cap 3, into the casing-tubing annulus, the conduit 15 having an inlet into every other cylinder and the conduit 14 having an inlet into the remaining cylinders, and the control cylinder 8. The control cylinder 8 will be packed off above the production formation 2, and will extend into the production formation, terminating in the upper and of the usual screen 16.

Check valve, as 17, 18, 19, prevent back flow of production fluid in the respective cylinders. In each cylinder the air inlet is at the top of the cylinder, and the production tubing 5 becomes a dip tube as 20 in the cylinders, terminating above the lower end of the respective cylinders. In control cylinder 8 the air inlet as at the top of the cylinder, and the production tubing terminates above the bottom wall of the cylinder, and a float valve, as 21, is mounted in the upper area of the control cylinder and has a contact point 22 mounted thereon which, when the fluid level in the control cylinder 8 rises to a point adjacent the top of the cylinder, will bring the contact point 22 into contact with the contact point 23, completing a circuit to the switch 11, which activates the motor 12 and the pump 24, which will send a surge of air under pressure into the conduit 14, and all cylinders connected into said conduit, driving the productin fluid therein upwardly, through the dip tube and into the next cylinder, respectively, where the air inlet is into the line 15, permitting an exhaust of the air therein, and upon the second movement of the four way valve, the air flow is directed into line 15, and line 14 becomes the exhaust line, permitting a lift into the next higher cylinder, leaving the cylinder above the control cylinder empty, ready for the next movement. As soon as the fluid in the control system is forced up the dip tube, the fluid level controlled switch 21 will break the contact of the points 22, 23, deactivating the switch 11, and deactivating the motor 12 and pump 24, upon completion of the cycle, and which will remain deactivated until the fluid level in the cylinder 8 again closes the switch 10.

A valve controlled inlet 26 permits introduction of chemicals into the air line for cleaning out the system.

The conduit 25 extends through the casing 1 at the ground surface, and downwardly through the casing-tubing annulus into the production formation, through which a vacuum may be drawn to assist in drawing production fluid into the casing around the screen 16.

What I claim is:

1. In a pump for wells, a well casing, a cap on said casing, a production tubing extending through said cap and into the production formation, a series of cylinders mounted in said production tubing, air conduits extending through said cap and having inlet connections into said cylinders, each line being connected into alternate cylinders, a motor operated four way valve controlling the flow of air through said conduits, exhausting alternate cylinders while forcing production fluid from the remaining cylinders, the lower most cylinder being a control cylinder, a fluid level controlled switch actuated by the fluid level in said cylinder to activate and deactivate the flow of air through said conduits and a valve and a conduit in one of said air conduits for the introduction of a chemical for cleaning the air control system.

* * * * *